US005698954A

United States Patent [19]

Hirota et al.

[11] Patent Number: 5,698,954

[45] Date of Patent: Dec. 16, 1997

[54] AUTOMATICALLY OPERATED ACCELERATOR USING OBTAINED OPERATING PATTERNS

[75] Inventors: Junichi Hirota, Hitachi; Kazuo Hiramoto, Hitachioota, both of Japan

[73] Assignee: Hitachi, Ltd., Tokyo, Japan

[21] Appl. No.: 436,270

[22] PCT Filed: Sep. 20, 1993

[86] PCT No.: PCT/JP93/01343

§ 371 Date: May 16, 1995

§ 102(e) Date: May 16, 1995

[87] PCT Pub. No.: WO95/08909

PCT Pub. Date: Mar. 30, 1995

[51] Int. Cl.[6] ..... H05H 13/04

[52] U.S. Cl. ..... 315/503; 315/5.42; 315/507

[58] Field of Search ..... 315/5.41, 5.42, 315/500, 501, 502, 503, 504, 505, 506, 507

[56] References Cited

U.S. PATENT DOCUMENTS 5,107,222 4/1992 Tsuzuki ..... 315/500

FOREIGN PATENT DOCUMENTS 3156900 7/1991 Japan ..... 315/501
3187200 8/1991 Japan ..... 315/503
3225800 10/1991 Japan ..... 315/503
4043599 2/1992 Japan ..... 315/503
4079199 3/1992 Japan ..... 315/503

*Primary Examiner*—Robert Pascal
*Assistant Examiner*—Justin P. Bettendorf
*Attorney, Agent, or Firm*—Antonelli, Terry, Stout & Kraus, LLP

[57] ABSTRACT

A beam transfer system has a bending magnet, a quadrupole magnet for converging or diverging a beam, and a beam current monitor. The controller of an accelerator body for the beam transfer system has a beam current measuring apparatus, a quantity-of-control measuring apparatus for measuring a quantity of control such as an exciting current of a bending magnet, a quantity-of-control determining apparatus for determining the quantity of control of each component, a trigger generating apparatus for generating various trigger signals, and a main controller for determining the quantity of control and the control timing of every component.

33 Claims, 11 Drawing Sheets

97
43
98
432
431
434
10,20–26

99
44
81
442
441
10,20–26

AUTOMATICALLY OPERATED ACCELERATOR USING OBTAINED OPERATING PATTERNS

TECHNICAL FIELD

The present invention relates to an accelerator, particularly to an accelerator which is automatically operated and which can preferably be used for industries or medical treatment. The present invention also relates to an operating method for such an accelerator.

BACKGROUND ART

As described in "Electronic 'Liniac' Beam Monitor OHO'86, High Energy Accelerator Seminar; Beam Monitor and Beam Instability, p. 4-1 (1986)" as the prior art, the starting operation of a circular accelerator and change of operation parameters are manually performed by observing the outputs of monitors such as a profile monitor, position monitor, and current monitor in accordance with previously calculated parameters.

The prior art is described below by taking the electron storage ring in FIG. 2 as an example. Electron beams obtained from a front accelerator 10 are shaped, aligned, and energy-sorted by an electromagnet group called a beam transfer system 11 and then applied to an electron storage ring 12. Thereafter, the electron beams are held on a certain orbit (hereafter referred to as a closed orbit) by the electromagnet group of the storage ring 12. Moreover, the electron beams are accelerated or kept in a storage state by receiving energy from an accelerating cavity 22 in the storage ring. This series of operations are called beam adjustment and is manually performed in the prior art while observing the outputs of various monitors set in the beam transfer system 11. The storage ring 12 and the operation of such an accelerator depends on experts. In the case of the above prior art, the starting operation and change of operation parameters are not easy because the beam adjustment is manually performed. Moreover, because the beam adjustment is manually performed in the case of the prior art, there are problems that a true operation parameter cannot easily be determined because there are too many parameters (e.g. exciting current of an electromagnet) to be determined and the beam adjustment greatly depends on the skill of an operator.

As other prior art, an accelerator for previously storing an exciting current to be supplied to a corrective electromagnet (for correcting the orbit of an electron beam) when a charged particle beam is injected into or extracted from a synchrotron and supplying the exciting current to the corrective electromagnet at a predetermined timing is disclosed in the official gazette of Japanese Patent Laid-Open No. 169100/1992.

Moreover, a control method for detecting a beam current taken out of a synchrotron and controlling the exciting current of an electromagnet so that the beam current is maximized is disclosed in the official gazette of Japanese Patent Laid-Open No. 140999/1983.

SUMMARY OF THE INVENTION

It is an object of the present invention to provide an operating method of an accelerator, an accelerator, and an accelerating system for realizing automatic operation in all modes of the accelerator without depending on the skill of an operator.

The above object is achieved by using data for injection energy, storage energy, and accelerating time of a charged particle beam of an accelerator, thereby obtaining operating patterns of components of the accelerator, and controlling the components in accordance with the obtained operating patterns.

Moreover, the above object is achieved by using data for injection energy, storage energy, accelerating time, extraction energy, and extraction current of a charged particle beam of an accelerator, thereby obtaining operating patterns of components of the accelerator, and controlling the components in accordance with the obtained operating patterns.

Furthermore, the above object is achieved by using an operating method of an accelerator provided with a first component for bending a charged particle beam and a second component for correcting the orbit of the beam, in which beam transfer is controlled for each of the components from the upstream side toward the downstream side of the traveling direction of the beam and thereafter beam transfer is controlled by relating all the components to each other from the upstream side toward the downstream side of the traveling direction of the beam.

Furthermore, the above object is achieved by using an operating method of an accelerator provided with a first component for bending a charged particle beam and a second component for correcting the orbit of the beam, in which a control signal is generated by using a beam current at two optional points at both sides of the components to control the components between the two points in accordance with the control signal.

The present invention makes it possible to automatically operate an accelerator without depending on the skill of an operator in all operation modes such as the starting operation, steady operation, and change of operating conditions by using data for injection energy, storage energy, and accelerating time of a charged particle beam, thereby obtaining operating patterns necessary for components of the accelerator such as a bending magnet for bending the beam, an orbit correction magnet for correcting the orbit of the beam, and an accelerating cavity for accelerating the beam, and controlling the components in accordance with the obtained operating patterns.

Moreover, the present invention makes it possible to automatically operate an accelerator in all operation modes without depending on the skill of an operator by using data for injection energy, storage energy, accelerating time, extraction energy, and extraction current of a charge particle beam, thereby obtaining operating patterns necessary for components such as a bending magnet for bending the beam, an orbit correction magnet for correcting the orbit of the beam, an accelerating cavity for accelerating the beam, and an extracting apparatus for extracting the beam, and controlling the components in accordance with the obtained operating patterns.

Furthermore, the present invention makes it possible to automatically operate an accelerator provided with a first component for bending a charged particle beam and a second component for correcting the orbit of the beam in all operation modes without depending on the skill of an operator by using an operating method of the accelerator, in which an optimum parameter for beam transfer obtained by correcting the combinational relation between components due to a leakage magnetic field can be determined by controlling the beam transfer for each of the components from the upstream side toward the downstream side of the traveling direction of the beam, thereafter relating all the components to each other from the upstream side toward the downstream side, and thereby controlling the beam transfer.

Furthermore, the present invention makes it possible to determine an optimum parameter for beam transfer obtained by correcting the combinational relation between components due to a leakage magnetic field and to automatically operate an accelerator in all operation modes without depending on the skill of an operator by using an operating method of an accelerator provided with a first component for bending a charged particle beam and a second component for correcting the orbit of the beam, in which both the beam transfer for each component and the beam transfer relating all components to each other can be controlled by using a beam current value at two optional points at both sides of the components to generate a control signal, and controlling the components between the two points in accordance with the control signal.

BEST MODE FOR CARRYING OUT THE INVENTION

Figure 1:
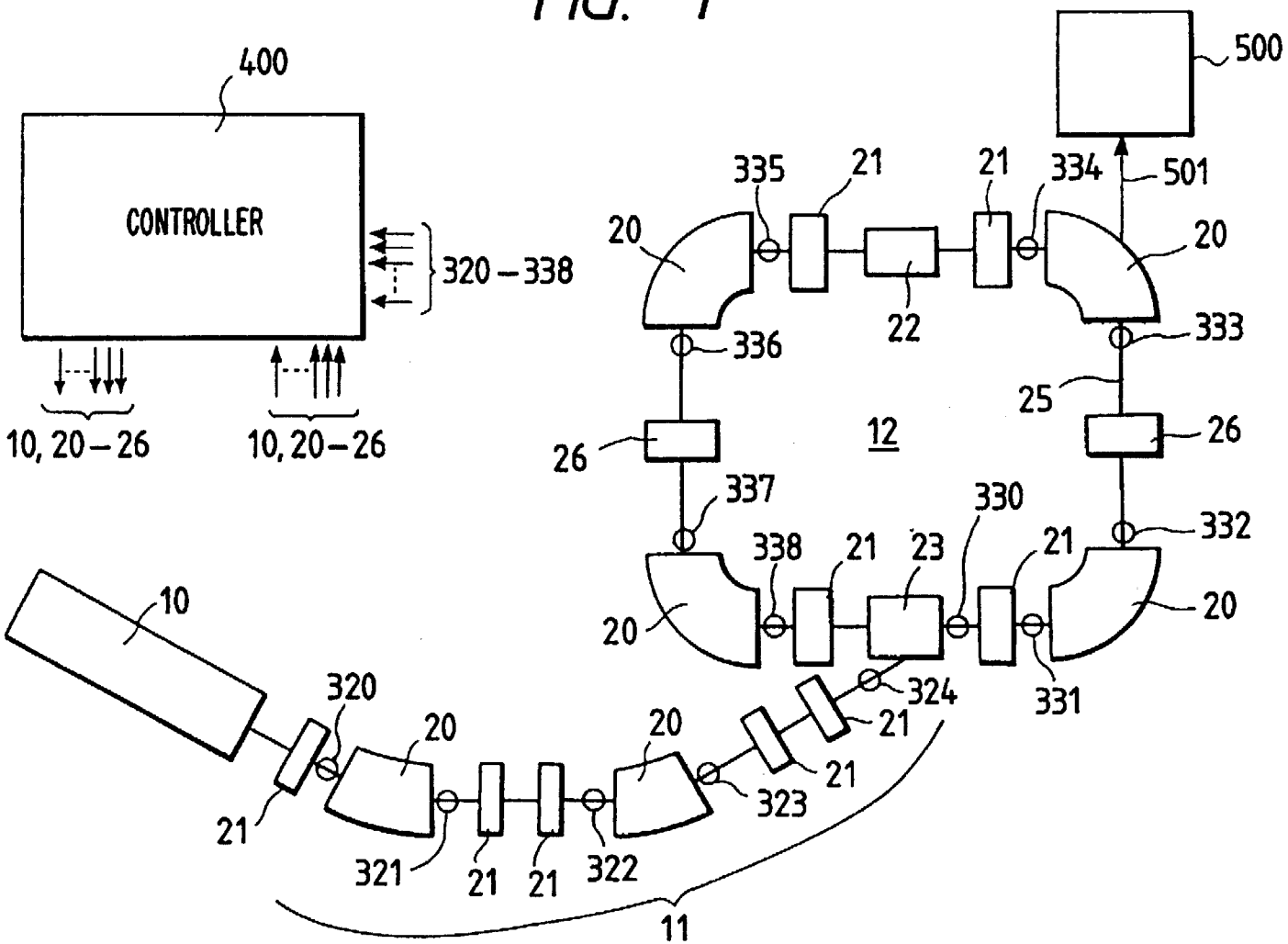
FIG. 1 is an illustration showing the first embodiment obtained by applying the present invention to a semiconductor aligner.
Figure 2:
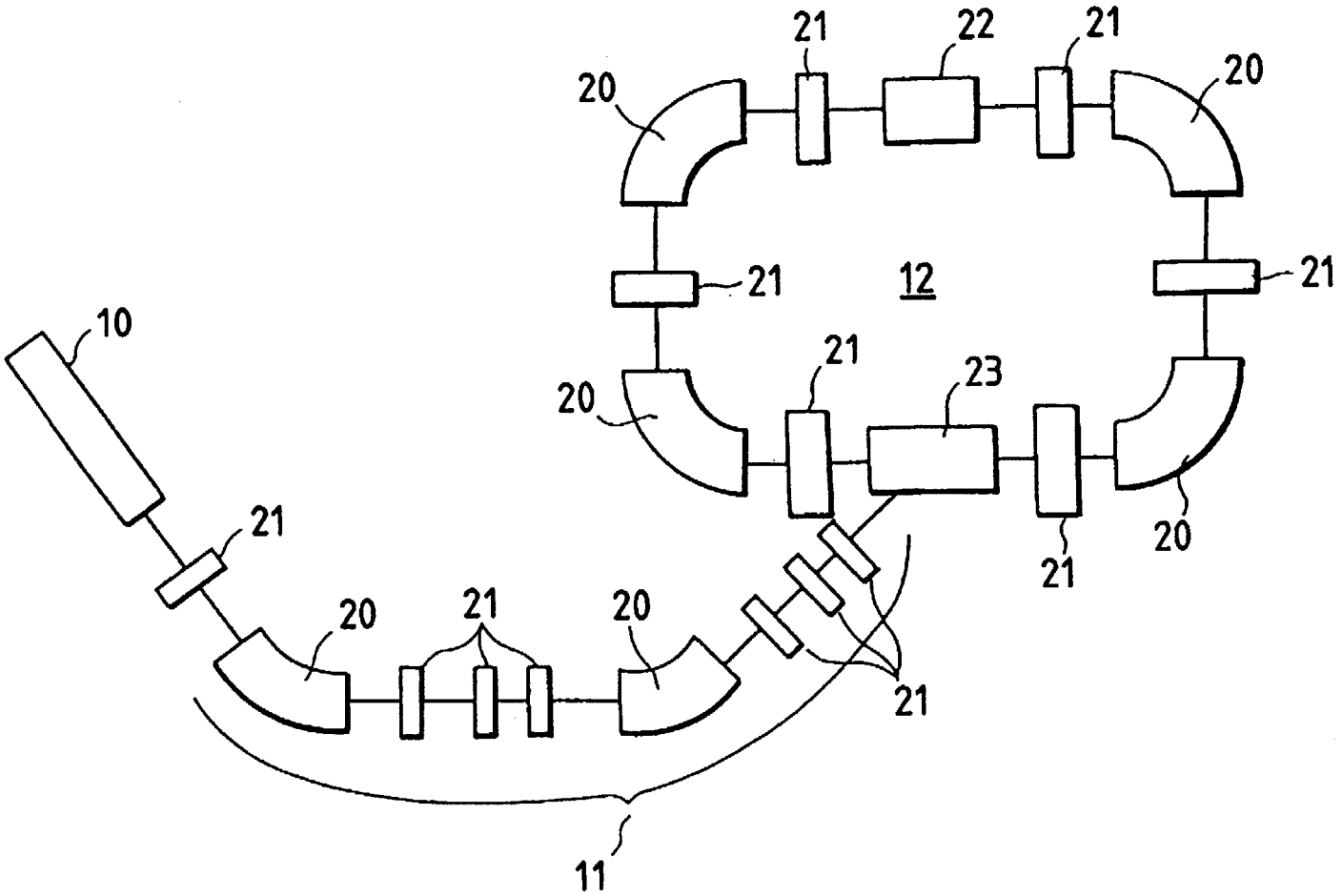
FIG. 2 PRIOR ART
FIG. 2 is an illustration showing an existing electron storage ring.

Embodiments of the present invention are described below by referring to the accompanying drawings. FIG. 1 is an illustration showing the first embodiment obtained by applying the present invention to a semiconductor aligner and FIG. 3 is an illustration showing the details of the controller in FIG. 1.

The semiconductor aligner of the first embodiment comprises the body of an accelerator for generating, accelerating, and storing an electron beam, a pattern transferring apparatus 500 for transferring a desired pattern onto a semiconductor substrate by using a radiation beam 501 extracted from the body of the accelerator, and a controller 400 for mainly controlling a plurality of components of the body of the accelerator.

The body of the accelerator comprises a front accelerator 10 for generating an electron beam, a beam transfer system 11 for transferring the electron beam generated by the front accelerator 10 to a storage ring 12, and a storage ring 12 for accelerating and storing the electron beam. A beam orbit in these components is enclosed by a vacuum duct 25 whose inside is evacuated to provide a vacuum. The beam transfer system 11 comprises a bending magnet 20 for bending an electron beam, a quadrupole magnet 21 for performing convergence and divergence of an electron beam, and current monitors 320 to 324 for measuring the beam current of the electron beam. The storage ring 12 comprises an injector 23 for injecting an electron beam into a storage ring, the bending magnet 20, the quadrupole magnet 21, a steering magnet 26 for fine-adjusting the position of the electron beam, the accelerating cavity 22 for accelerating the electron beam, and current monitors 320 to 338. The current monitors 320 to 338 are arranged at the front and rear of the bending magnet 20 so as to sandwich the magnet 20.

Figure 3:
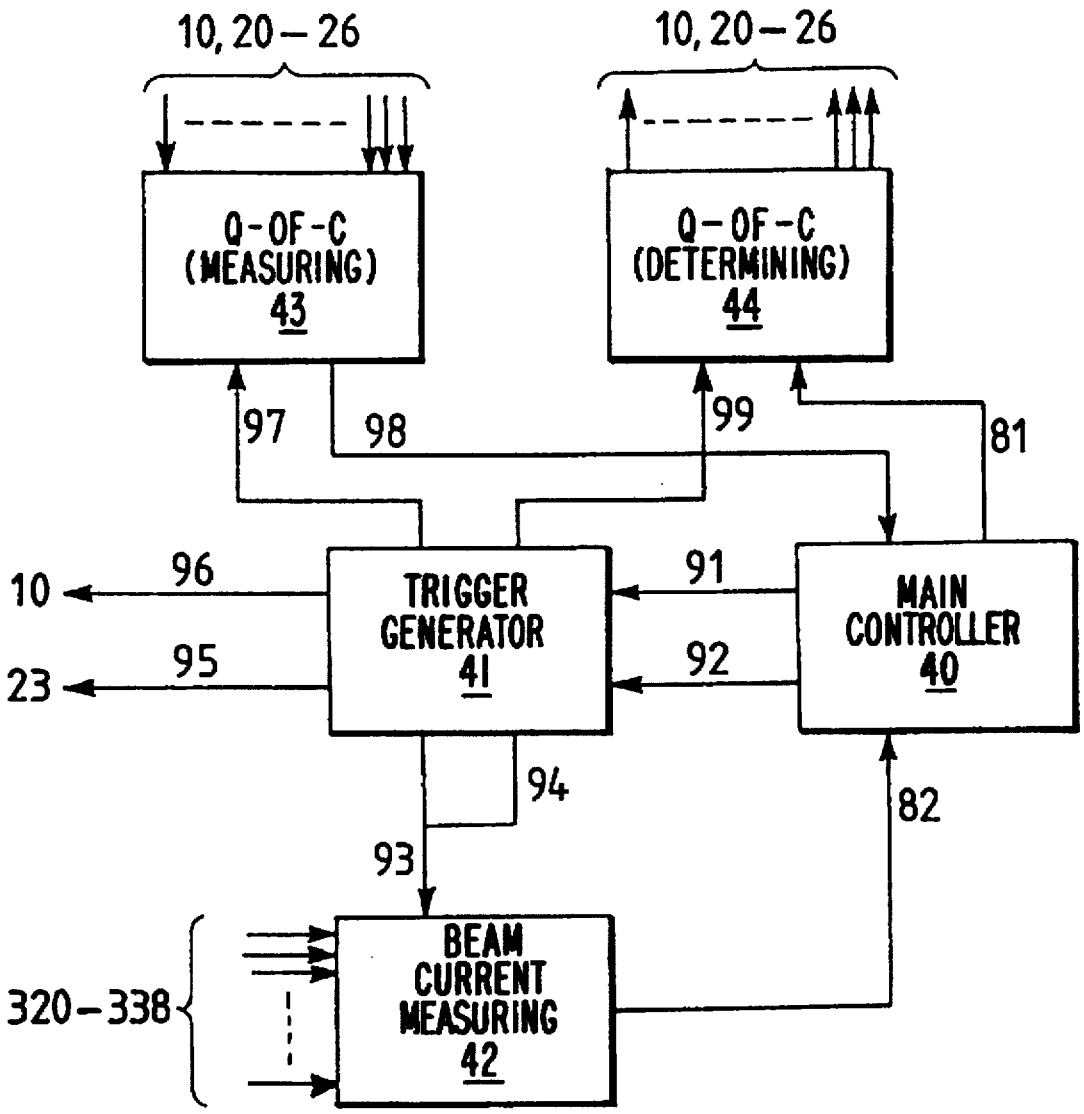
FIG. 3 is an illustration showing the details of the controller in FIG. 1.

The controller 400 for monitoring and controlling the operation of an accelerator, as shown in FIG. 3, comprises an input section which includes a beam current measuring apparatus 42 for receiving input data from the current monitors 320–338 and measuring the beam current of an accelerator at a predetermined timing and a quantity-of-control measuring apparatus 43 for receiving input data from the front accelerator 10 and the elements 20 to 26 and measuring the temperature of a cathode of the front accelerator 10 or the quantity of control such as the exciting current of the bending magnet 20, quadrupole magnet 21, and steering magnet 26 at a predetermined timing. The controller 400 also comprises a quantity-of-control determining apparatus 44 for determining the quantity of control of each component at a predetermined timing; a trigger generating apparatus 41 for generating trigger signals (hereafter referred to as various trigger signals) for measurement of beam current by the beam current measuring apparatus 42, measurement of quantity of control by the quantity-of-control measuring apparatus 43, determination of quantity of control by the quantity-of-control measuring apparatus 44, and injection, extraction, acceleration, and deceleration of an electron beam of an accelerator; and a main controller 40 which performs arithmetic operations for determining the quantity of control and the control timing of every component.

Figure 5:
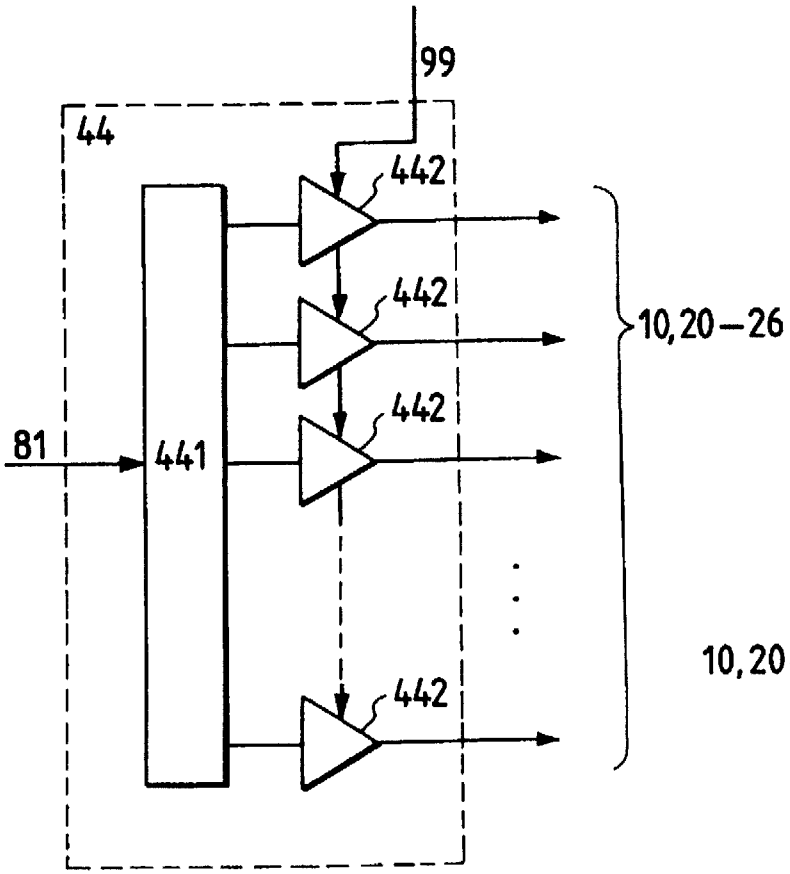
FIG. 5 is an illustration showing the details of the apparatus for determining quantity of control in FIG. 3.

The quantity-of-control determining apparatus 44, as shown in FIG. 5, comprises a buffer 441 for holding a control signal 81 outputted from the main controller 40 and a D-A converter 442 for converting a digital signal to an analog signal in accordance with a determination trigger signal 99 outputted from the trigger generating apparatus 41.

Figure 6:
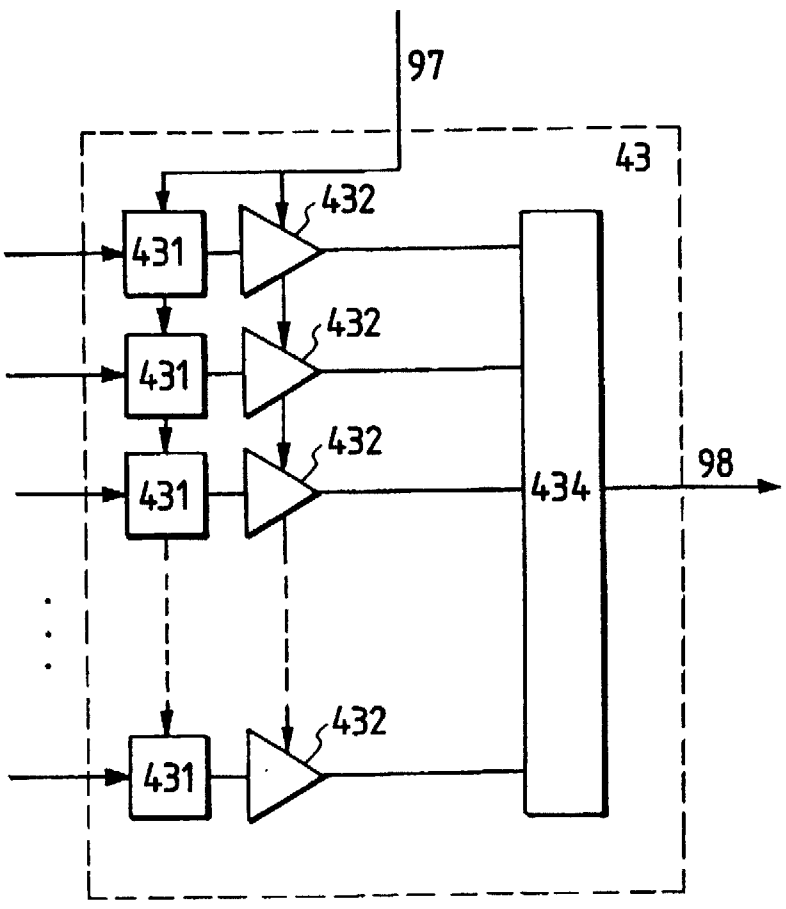
FIG. 6 is an illustration showing the details of the apparatus for measuring quantity of control in FIG. 3.

The quantity-of-control measuring apparatus 43, as shown in FIG. 6, comprises a sample hold circuit 431 for holding a monitor signal outputted from a power supply for the front accelerator 10 and various magnets when a measurement trigger signal 97 is outputted from the trigger generating apparatus 41, an A-D converter 432 for converting an analog signal held by the sample hold circuit 431 to a digital signal, and a buffer 434 for accumulating digital signals.

Figure 7:
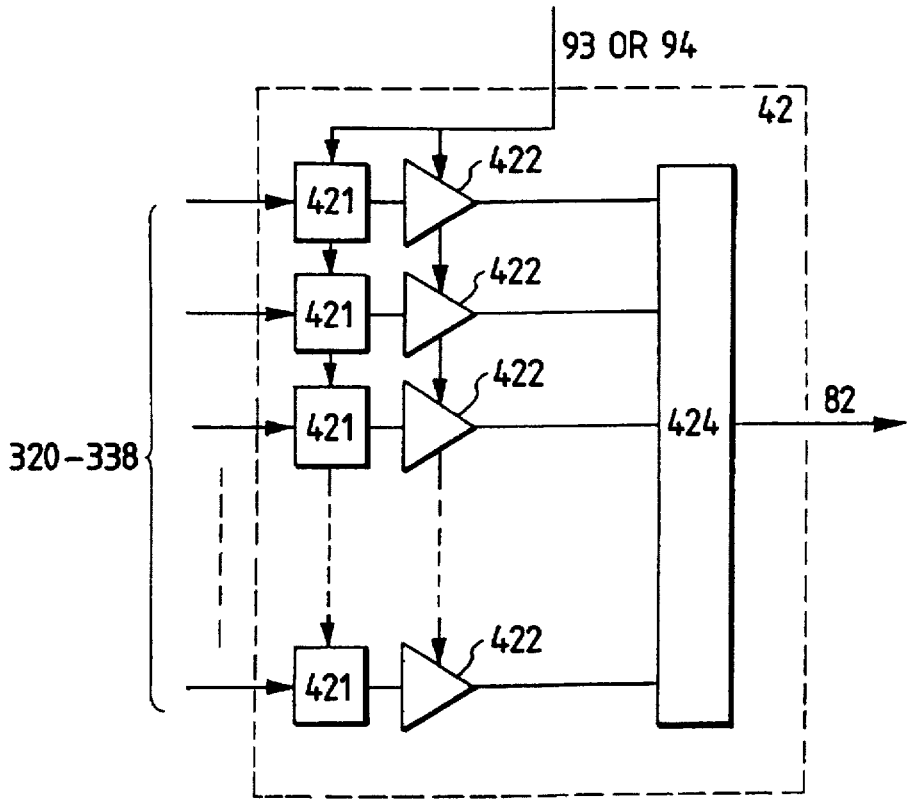
FIG. 7 is an illustration showing the details of the apparatus for measuring beam current in FIG. 3.

The beam current measuring apparatus 42, as shown in FIG. 7, comprises a sample hold circuit 421 for holding a monitor signal outputted from the current monitors 320 to 338, an A-D converter 422 for converting an analog signal held by the sample hold circuit 421 to a digital signal, and a buffer 424 for accumulating digital signals.

Figure 8:
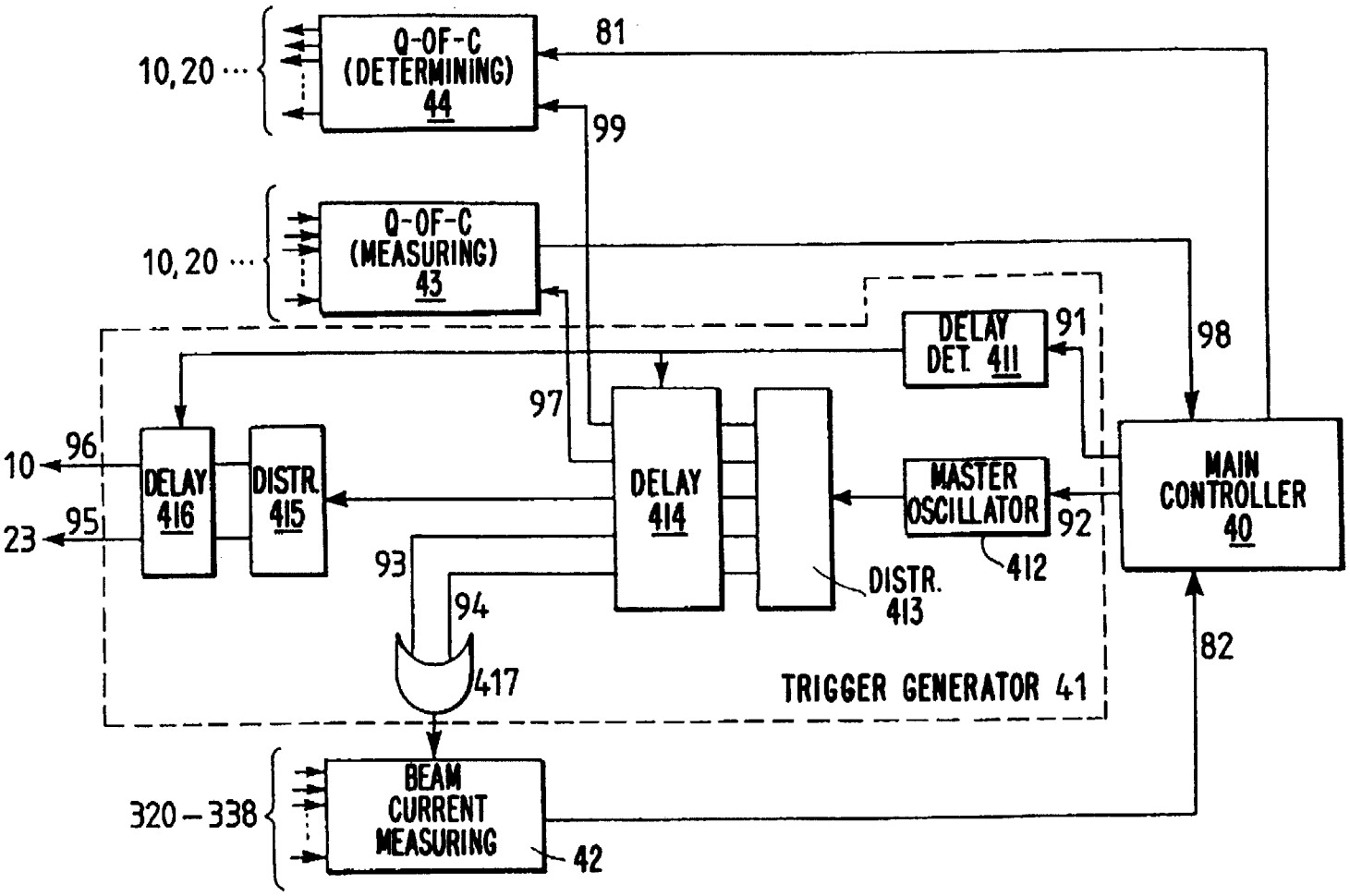
FIG. 8 is an illustration showing the details of the apparatus for generating trigger signal in FIG. 3.

The trigger generating apparatus 41, as shown in FIG. 8, comprises a master oscillator 412, a distributor 413 for distributing a single output of the master oscillator 412 to a plurality of outputs, a delaying unit 414 for giving a proper delay time to each trigger signal for quantity-of control determination, quantity-of control measurement and beam current measurement, a distributor 415 for distributing the output of the delaying unit 414 to the front accelerator 10 and the injector 23, a delaying unit 416 for giving an intrinsic delay time necessary for the front accelerator 10 and the injector 23 to the output of the distributor 415, a device 411 for determining a delay time outputted by the delay circuits 414 and 416, and an OR circuit for operating the beam current measuring apparatus 42 when either of a trigger signal 93 for measuring beam current and a trigger signal 94 for confirming the number of accumulated beams is inputted. It is also possible to use a constitution in which the output of the master oscillator 412 is directly inputted to the distributor 415.

Figure 9:
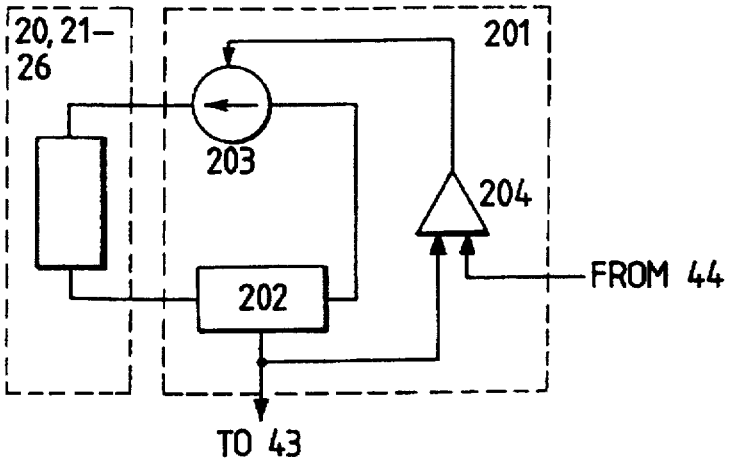
FIG. 9 is an illustration showing the connection between a magnet and a magnet current.

FIG. 9 shows the connection between the bending magnet 20, quadrupole magnet 21, and steering magnet 26 on the hand and the quantity-of-control measuring apparatus 43 and the quantity-of-control determining apparatus 44 on the other. A magnet power supply 201 comprises an exciting-current monitor 202 for measuring the exciting current of a magnet (20, 21, or 26) which is a load, a current source 203 for supplying an exciting current to a magnet, and a feedback circuit 204 for controlling the output current of the current source 203. The feedback circuit 204 compares a determined value of the magnet exciting current outputted from the quantity-of-control determining apparatus 44 with a measured value of the exciting current measured by the exciting current monitor 202 and sets the difference between the determined value and the measured value to the current source 203. At the same time, the exciting current measured by the exciting current monitor 202 is transmitted to the quantity-of-control measuring apparatus 43.

The main controller 40 is connected with the beam current measuring apparatus 42, quantity-of-control measuring apparatus 43, and quantity-of-control determining apparatus 44 by a parallel cable so that data can be transferred bidirectionally between them.

The starting operation of the body of the accelerator in FIG. 1 is described below by referring to the flow chart shown in FIG. 4. An electron beam is generated by the front acceleration 10, and the energy and profile of the beam are arranged by the beam transfer system 11 and injected into the storage ring 12. Thereafter, the electron beam is accelerated by a synchrotron and accumulated in the storage ring 12. This series of acceleration operating methods is summarized below.

(1) Control signals 81 for the initial value, variable range, and variable step (width) of the quantity of control of each component of the accelerator are outputted from the main controller 40 to the quantity-of-control determining apparatus 44, and moreover various trigger signals 91 and 92 for the determining cycle and measuring cycle of quantity of control, and the injection timing, acceleration timing, deceleration timing, acceleration pattern, and deceleration pattern of the beam are outputted from the main controller 40 to the trigger generating apparatus 41.

(2) Each component are made to wait under the stage of the initial determined value.

(3) A beam output signal 96 is transmitted from the trigger generating apparatus 41 to the front accelerator 10 to generate an electron beam (step 150 in FIG. 4) and a measurement trigger signal 93 is transmitted to the beam current measuring apparatus 42.

(4) Regarding the quantity of control of the components between current monitors, the variable range determined in the above Item (1) is sequentially searched for each variable step along the traveling direction of a beam from the current monitor 320 to the current monitor 324 in the beam transfer system 11 so that the output of the downstream-side monitor out of two consecutive monitor signals is maximized, in other words, the transmittance is maximized. For example, the exciting current of the bending magnet 20 is controlled in the case of the current monitors 320 and 321 and the exciting currents of two quadrupole magnets 21 are controlled in the case of the current monitors 323 and 324.

Figure 4:
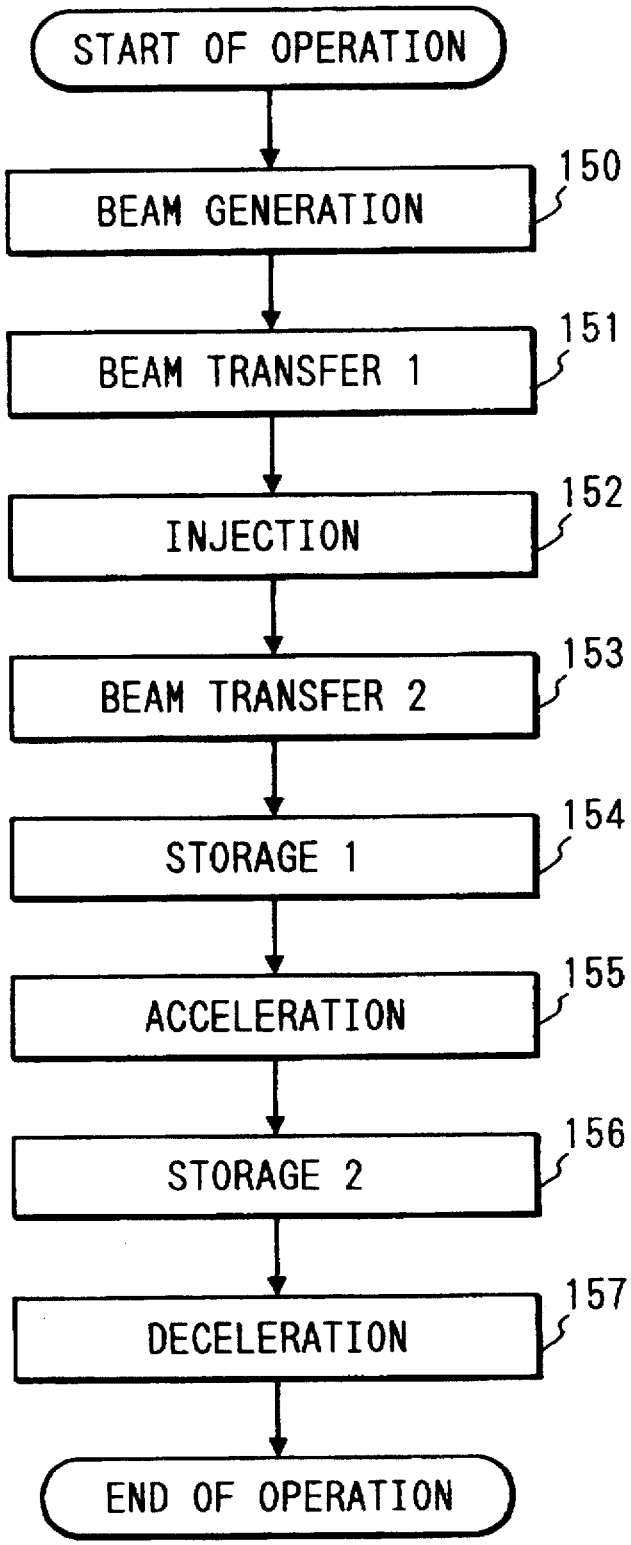
FIG. 4 is an illustration showing a starting method of the body of an accelerator in FIG. 1.

Thus, beam transfer in the beam transfer system 11 is started (step 151 in FIG. 4).

(5) The operation the same as that in Item (4) is performed between the current monitors 324 and 330 to inject an electron beam into the storage ring (step 152 in FIG. 4).

(6) The operation the same as that in Item (4) is performed between the current monitors 330 and 338 to perform beam transfer in the storage ring 12 (step 153 in FIG. 4).

By the above operations (4) to (6), that is, by maximizing the output of the current monitor 338, orbiting of the electron beam in the storage ring 12 is confirmed. At this stage, however, the number of accumulated electron beams is not confirmed.

The number of accumulated electron beams can be confirmed by the fact that the time width of the output signal of any current monitor (any one of the current monitors 330 to 338) increases with passage of time.

(7) The trigger signal 94 for confirming the number of accumulated beams is generated by the trigger generating apparatus 41 a sufficient time (time required for an electron beam to orbit in the storage ring 100 to 200 times) after the beam output signal 96 is sent to the front accelerator 10 to sequentially search the exciting currents of the bending magnet 20 and the quadrupole magnet 21 in the storage ring 12 so as to maximize the beam current signal obtained from the current monitor 338 (step 154 in FIG. 4).

By the above operation, the number of accumulated electron beams is confirmed and coarse adjustment as the acceleration preparing stage is completed.

(8) The determined value is adjusted for each variable step and each component again in the variable range determined in Item (1) starting with the initial component of the beam transfer system 11 so that the monitor signal or the storage current of the current monitor 338 at the lowest downstream side of the storage ring 12 is maximized.

The fine adjustment in Item (8) is necessary because of the following reasons. In the case of a beam obtained from the front accelerator 10, the energy is almost known but the position and gradient are not known. Moreover, the ranges of energy, position, and gradient which can be captured by a storage ring or synchrotron are not large in general (e.g. approx. 1%). Therefore, the beam transfer parameter obtained in Item (7) serves as a correct parameter when magnet systems for performing beam transfer are independent of each other. In fact, however, because the magnets are loosely combined due to the multipole magnetic field component, leakage magnetic field, setting error of the magnets, a desired energy, position, and gradient are not always obtained. To finally maximize the output of the current monitor set at the final stage, the outputs of the current monitors during beam transfer are not maximized in most cases. Thereafter, an optimum parameter for beam transfer can be determined by adjusting each component used for beam transfer so as to maximize the output of the current monitor at the final stage as described in the above Item (8).

Thus, the preparation conditions for acceleration in FIG. 4 are determined.

(9) The data for the acceleration pattern obtained in Item (1) is corrected in accordance with the determined values of the components of the storage ring 12 obtained in Item (8) and the acceleration trigger signal is transmitted to each component to perform acceleration (step 155 in FIG. 4).

(10) While acceleration is performed, the measurement trigger signal 93 is transmitted from the trigger generating apparatus 41 to the beam current measuring apparatus 42 to measure the change of the beam current under acceleration. In this case, if the electron beam emits a radiation beam, it is possible to measure the luminous energy of the radiation. If it is found from the measurement result that the beam current suddenly changes, the position is determined and the determined value of the component arranged at the determined position is adjusted for each step in the variable range determined in Item (1).

(11) The operations in Items (9) to (10) are repeated until the storage current does not suddenly change.

The operations in Items (9) to (11) are executed until the ratio of the storage current at the end of acceleration to the storage current before acceleration is maximized. By these operations, electrons are accelerated and accumulated up to a desired energy (step 156 in FIG. 4).

(12) When a predetermined storage time has passed or the storage current has come to a predetermined storage current value or less after succeeding in acceleration, the storage is terminated and a trigger signal for deceleration is transmitted to each unit to perform deceleration in accordance with the data for a predetermined deceleration pattern (step 157 in FIG. 4).

Thus, one operation cycle terminates.

In the above case, the transmission value of the beam current between two consecutive current monitors is maximized. It is also possible to similarly perform beam transfer between two optional monitors. Moreover, it is possible to set the current transmission value to not only the maximum value but also a desired value.

Then, judgment on the quality of beam transfer is described below in detail. As described above, the determined value, initial value, final value, increment, delay time, and patterns of various trigger signals are first computed in the main controller 40 for beam transfer and computed values are set to each unit. Then, an operation start signal (beam-on, beam output signal for the front accelerator 10) is transmitted from the main controller 40 to the trigger generating apparatus 41. Thereby, the output signal of the master oscillator 412 is transmitted to the distributor 413 and various trigger signals distributed by the distributor 413 are delayed by the delay time intrinsic to each unit and transmitted to each unit.

First, current values of the power supplies of the bending magnet 20, quadrupole magnet 21, steering magnet 26, and accelerating cavity 22 are determined to apply current to each load. The current is measured by using a current monitor (mainly, shunt resistance in the case of a magnet power supply) and the quantity-of-control measuring apparatus 43 to transfer the measured value 98 to the main controller 40. At the same time, the beam current is measured by using the current monitors 320 to 338 set to the body of an accelerator and the beam current measuring apparatus 42 to transfer the measured value 82 to the main controller 40.

By the above operations, the main controller 40 judges the quality of beam transfer in accordance with a predetermined value and the beam-current measured value 82 and repeats the operation until beam transfer succeeds. At the acceleration stage, the quantity of control and the beam current under acceleration can be measured by previously setting an acceleration pattern to the quantity-of-control measuring apparatus 44, thereafter transmitting an acceleration trigger signal from the main controller 40 to the trigger generating apparatus 41, and holding the signal until acceleration terminates. Thus, the quality of acceleration can be judged.

Figure 10:
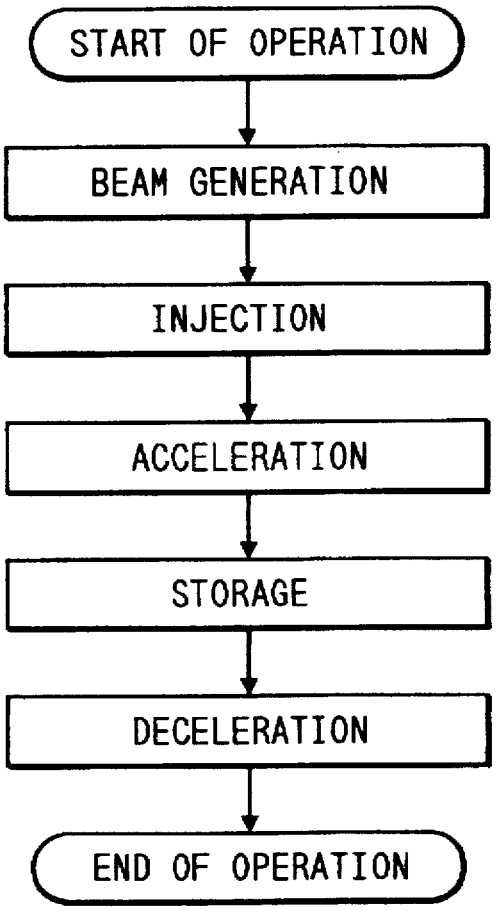
FIG. 10 is an illustration showing a steady operating method of the body of an accelerator.
Figure 11:
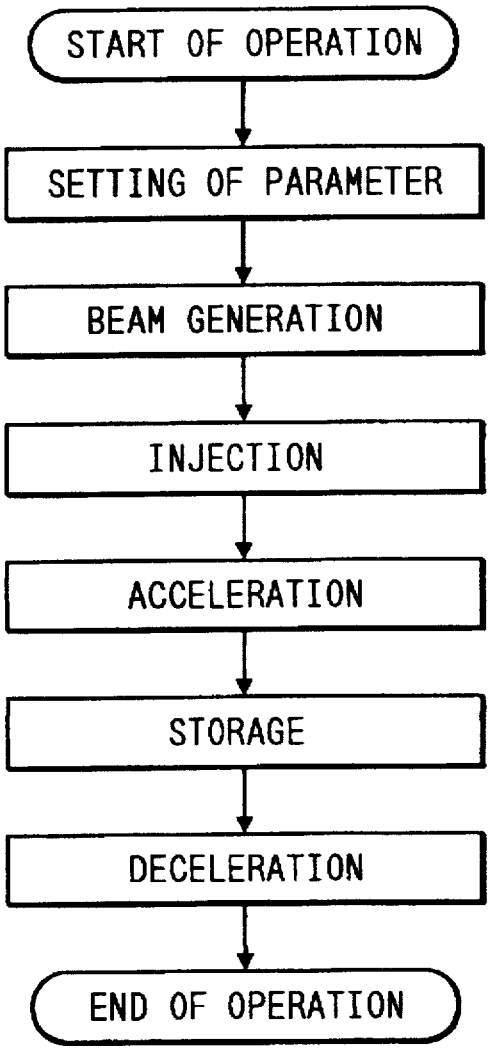
FIG. 11 is an illustration showing an operating method for changing the operating conditions of the body of an accelerator.

The starting method of the body of an accelerator is described above. For the steady operation in which operating conditions are constant, however, the occurrence, injection, acceleration, storage, and deceleration of a beam are pattern-operated in accordance with the operating patterns obtained in the above Items (1) to (12) as shown in FIG. 10. To change the operating conditions, a new parameter is determined at first, an operating pattern is corrected in accordance with the parameter, and thereby the pattern operation from generation to deceleration of a beam is performed.

Then, the second embodiment obtained by applying the present invention to a semiconductor aligner is described below by referring to FIG. 12. The body of the accelerator of this embodiment comprises a front accelerator 10 for generating an electron beam, a beam transfer system 11 for transferring the electron beam generated by the front accelerator 10 to an accelerating synchrotron 13, the accelerating synchrotron 13 for accelerating the electron beam, a beam transfer system 14 for transferring the electron beam accelerated to a high energy from the accelerating synchrotron 13 to a storage ring 12, and the storage ring 12 for accumulating electron beams.

This is an independent constitution as the accelerating synchrotron 13 by using the electron-beam accelerating function of the storage ring 12 of the embodiment shown in FIG. 1.

Figure 12:
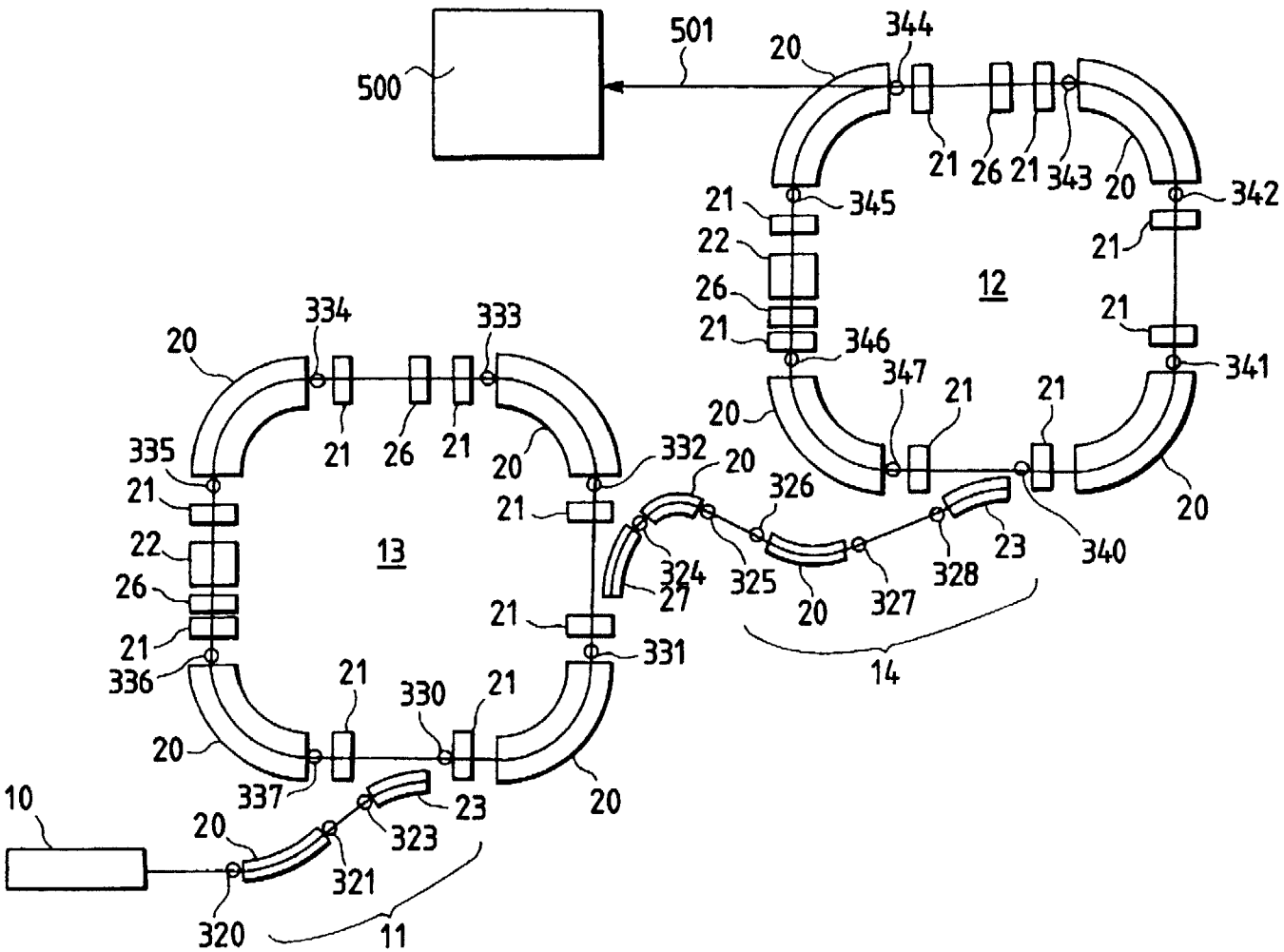
FIG. 12 is an illustration showing the second embodiment obtained by applying the present invention to a semiconductor aligner.
Figure 13:
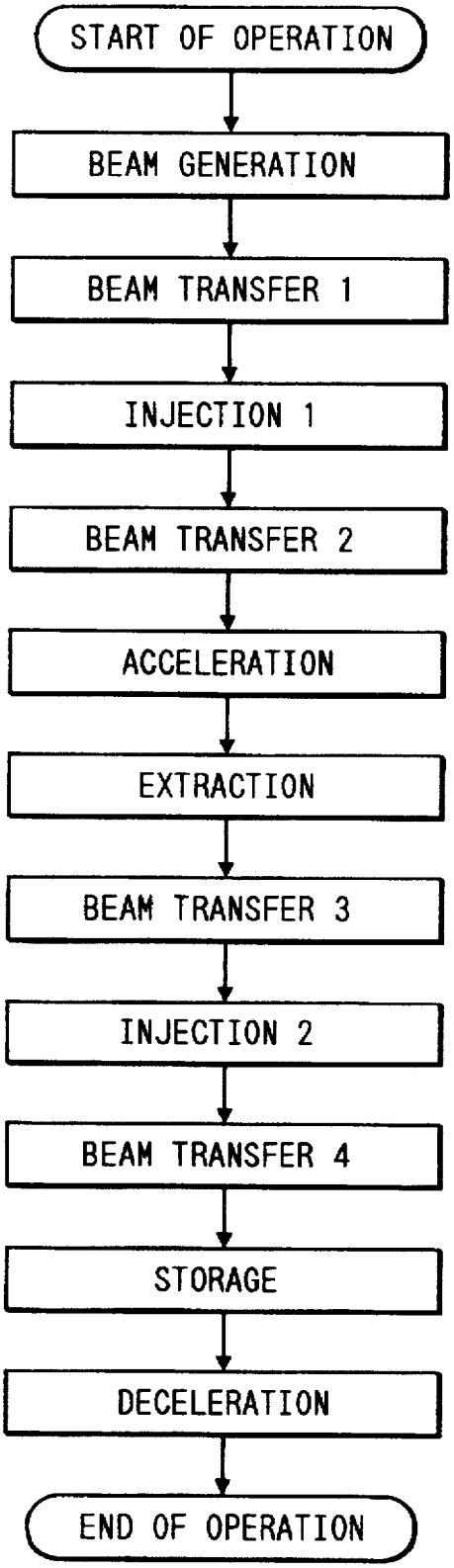
FIG. 13 is an illustration showing an operating method of the body of an accelerator.

FIG. 13 shows an operating method of the body of the accelerator in FIG. 12. Though the flow of the operating method in FIG. 13 is almost the same as that in FIG. 4, beam extraction from the accelerating synchrotron 13, beam transportation (beam transfer 3) in the beam transfer system 14, and beam injection (injection 2) to the storage ring 12 are newly added. However, the adjustment method using the current monitors 320 to 338 in FIG. 1 can also be applied to the current monitors 320 to 347 in FIG. 10. Moreover, the trigger generating apparatus 41 shown in FIG. 8 is constituted so as to also generate the trigger signals for beam extraction from the accelerating synchrotron 13 and beam injection to the storage ring 12.

Furthermore, by setting a beam distributing magnet in the beam transfer system 14 for connecting the accelerating synchrotron 13 with the storage ring 12 in FIG. 12, it is also possible to constitute an accelerator system for supplying electron beams extracted from the accelerating synchrotron 13 to a plurality of storage rings 12.

Then, the third embodiment obtained by applying the present invention to a medical system is described below by referring to FIG. 14. This embodiment comprises a front accelerator 10 for generating a charged particle beam, a beam transfer system 11 for transferring the charged particle beam generated by the front accelerator 10 to an accelerating synchrotron 13, the accelerating synchrotron for accelerating the charged particle beam, a beam transfer system 15 for transferring the charged particle beam accelerated to a high energy from the accelerating synchrotron 13 to an irradiation room 16, and the irradiation room 16 for performing irradiating treatment by using the charged particle beam.

Charged particle beams accelerated by the accelerating synchrotron 13 are extracted from an extractor 27 and distributed to a plurality of irradiation rooms 16 in order by a distributing magnet 28 set in the beam transfer system 15.

Figure 15:
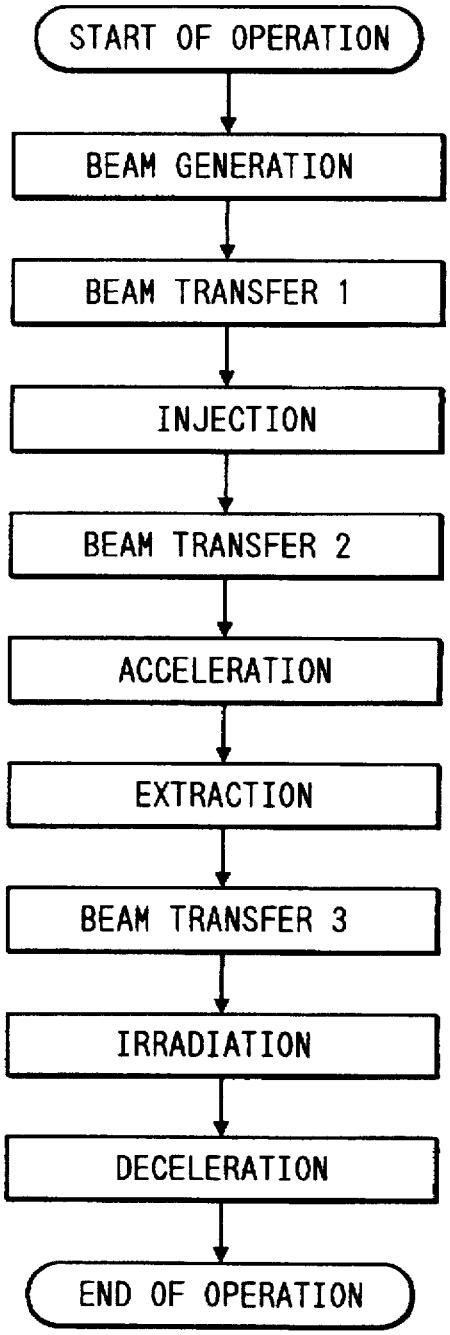
FIG. 15 is an illustration showing an operating method of the medical system in FIG. 14.
Figure 14:
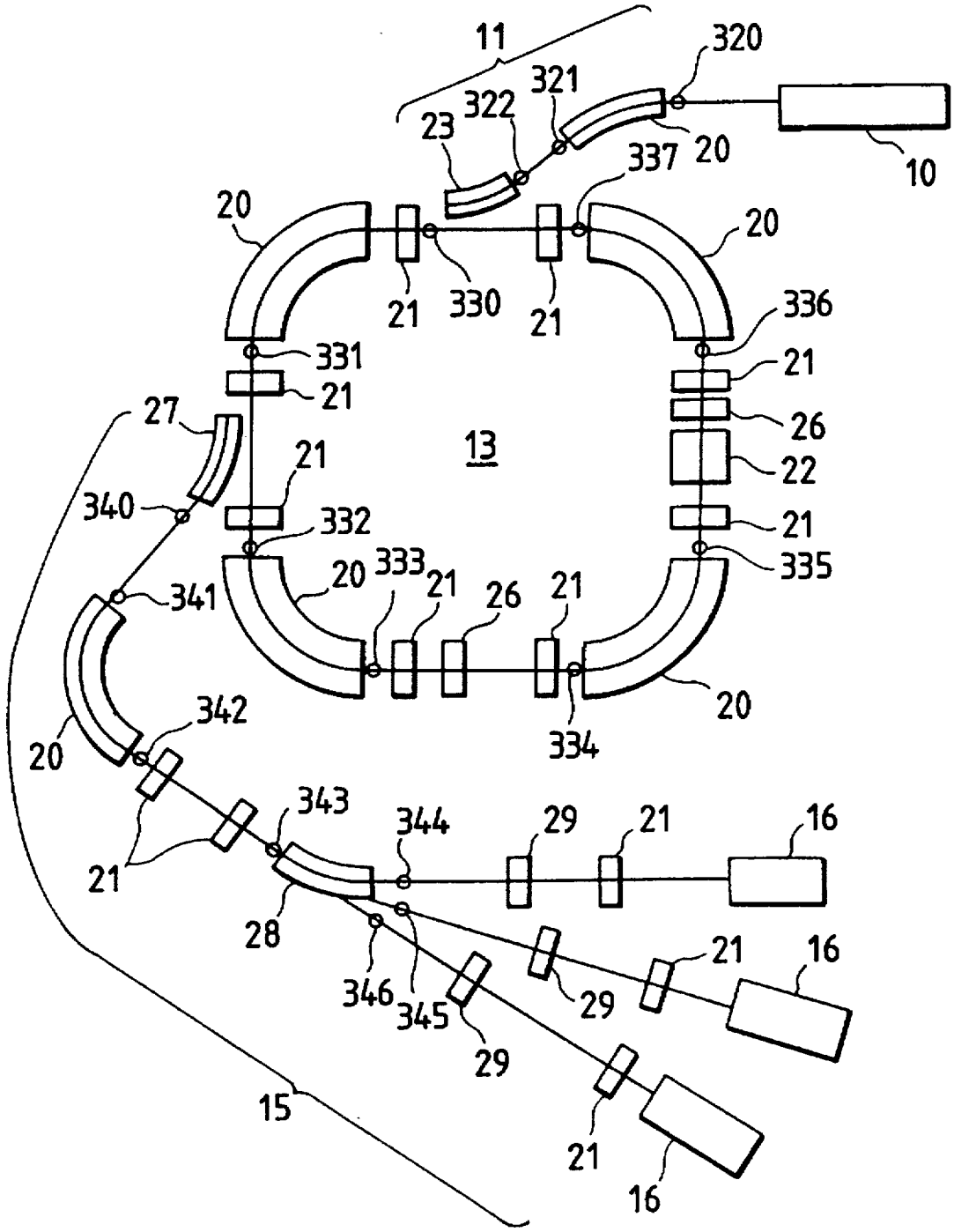
FIG. 14 is an illustration showing the third embodiment obtained by applying the present invention to a medical system.

FIG. 15 shows an operating method of the medical system in FIG. 14. When using an charged particle beam for irradiation therapy, it is necessary to change an acceleration energy and electron beam current (dose) in accordance with the depth of the affected part of a patient to be irradiated with a charged particle beam. The acceleration energy is determined by the final value of the data for the acceleration pattern of the bending magnet 20 of the accelerating synchrotron 13 and the final value is previously determined.

Then, methods for transferring charged particle beams up to a plurality of irradiating rooms while controlling the beam current are described below. In the case of the first method, the quantity of control for each component up to each irradiating room 16 is determined so that the output signals of the current monitors 320 to 346 set for each bending magnet 20 are maximized or the attenuation of the beam current at the position of a current monitor of the downstream side to the position of a current monitor of the upstream side is minimized when no patient is present in the irradiating room 16. Thus, the operation parameter of the accelerator system is determined. In this case, the outputs of the current monitors 344, 345, and 346 immediately before the irradiating rooms 16 are stored. The outputs are converted into doses and the beam current generated by the front accelerator 10 is increased or decreased so as to meet a predetermined dose requirement in the irradiating room 16.

In the case of the second method, the procedure is the same as the first method up to the determination of the operation parameter of the accelerating synchrotron 13 but up to the step of extraction in FIG. 15 is performed so that the beam current is maximized. Thereafter, a damper 29 is inserted in the middle of the beam transfer system 15 so that the beam current at the position where the beam transfer system 15 is present comes to a desired beam current. The damper 29 uses, for example, a scatterer to decrease the beam current by scattering. By using the damper 29, it is possible to change the dose for each irradiating room. In this case, means for monitoring the beam current can use means for directly measuring the beam current or means for measuring a radiation dose or the like caused by collision between a beam and a material. This method makes it possible to irradiate a patient with a desired dose at a desired energy.

Moreover, if a trouble occurs in any one of the components constituting an accelerator, it is possible to specify the defective component at the position of a current monitor with an extremely small beam current by continuously monitoring the current monitors set to various positions. Therefore, it is possible to detect by and display on a controller a defective component.

Industrial Applicability

As described above, the present invention makes it possible to provide an operating method of an accelerator to be automatically operated without depending on the skill of an operator in every operation mode, such as startup and steady operations and operation condition change, the accelerator, and an accelerating system.

We claim:

1. An operating method of an accelerator, comprising the steps of:

obtaining an operating pattern of a component of the accelerator by using data for the injection energy, storage energy, and accelerating time of a charged particle beam of the accelerator; and controlling the component in accordance with the operating pattern.

2. An operating method of an accelerator, comprising the steps of:

obtaining an operating pattern of a component of the accelerator by using data for the injection energy, storage energy, accelerating time, and storage current of a charged particle beam of the accelerator; and controlling the component in accordance with the operating pattern.

3. An operating method of an accelerator, comprising the steps of:

obtaining an operating pattern of an component of the accelerator by using data for the injection energy, storage energy, accelerating time, extraction energy, and extraction current of a charged particle beam of the accelerator; and controlling the component in accordance with the operating pattern.

4. An operating method of an accelerator, comprising the steps of:

obtaining the operating patterns of a first component for bending a charged particle beam of the accelerator, a second component for fine-adjusting the position of the electron beam, and a third component for accelerating the beam by using data for the injection energy, storage energy, accelerating time, and storage current of the beam of the accelerator; and controlling the first, second, and third components in accordance with the operating patterns.

5. The operating method of an accelerator according to claim 4, wherein the first component is a bending magnet, the second component is a steering magnet, and the third component is an accelerating cavity.

6. An operating method of an accelerator, comprising the steps of:

obtaining the operating patterns of a first component for bending a charged particle beam of the accelerator, a second component for fine-adjusting the position of the electron beam, a third component for accelerating the beam, and a fourth component for extracting the beam by using data for the injection energy, storage energy, accelerating time, extraction energy and extraction current of the beam of the accelerator; and controlling the first, second, third, and fourth components in accordance with the operating patterns.

7. The operating method of an accelerator according to claim 6, wherein the first component is a bending magnet, the second component is a steering magnet, the third component is an accelerating cavity, and the fourth component is an extracting apparatus.

8. An acceleration system comprising:

an accelerator comprising:

a first component for bending a charged particle beam;

a second component for fine-adjusting the position of the electron beam;

a third component for accelerating the beam;

a fourth component for extracting the beam;

a controller comprising:

a beam current measuring apparatus for measuring the current of a charged particle beam;

a quantity-of-control measuring apparatus for measuring the quantity of control of a component of an accelerator;

a quantity-of-control determining apparatus for determining the quantity of control of the component and outputting a control signal;

a trigger generating apparatus for outputting trigger signals for the outputting of a control signal by the quantity-of-control determining apparatus, measurement of a quantity of control by the quantity-of-control measuring apparatus, measurement of a beam current by the beam current measuring apparatus, and injection, extraction, acceleration, and deceleration of the beam; and a main controller for controlling the outputting of a trigger signal by the trigger generating apparatus and the determination of a quantity of control by the quantity-of-control determining apparatus;

a power supply for supplying power to each of the components in accordance with the control signal outputted from the controller; and a current detector for detecting the current of the beam and transmitting the detection signal to the beam current measuring apparatus of the controller;

a beam transfer system for transferring the beam extracted from the fourth component of the accelerator to a plurality of irradiating rooms;

a distributing apparatus for distributing the beam to the plurality of irradiating rooms; and an irradiating apparatus set in the irradiating room to irradiate an irradiation object with the beam.

9. An operating method of an accelerator provided with a first component for bending a charged particle beam and a second component for fine-adjusting the position of the electron beam, comprising the steps of:

controlling beam transfer for each of the components from the upstream side toward the downstream side of the traveling direction of the beam; and thereafter controlling the beam transfer by relating all the components each other from the upstream toward the downstream sides.

10. The operating method of an accelerator according to claim 9, wherein the first component is a bending magnet and the second component is a steering magnet; and the components between the two points are controlled by controlling the exciting current of the bending magnet or orbit correcting magnet.

11. An operating method of an accelerator provided with a first component for bending a charged particle beam and a second component for fine-adjusting the position of the electron beam, comprising the steps of:

controlling a beam current value passing through each of the components from the upstream side toward the downstream side of the traveling direction of the beam so that the beam current value is maximized; and thereafter controlling all the components from the upstream toward the downstream sides so that a beam current value at the lowest downstream side is maximized.

12. An operating method of an accelerator provided with a first component for bending a charged particle beam and a second component for fine-adjusting the position of the electron beam, comprising the steps of:

generating a control signal by using a beam current between two optional points at the both sides of the components; and controlling the components between the two points in accordance with the control signal.

13. The operating method of an accelerator according to claim 11, wherein the components between the two points are controlled so that the attenuation ratio or transmittance of the beam current value at a point of the downstream side of the traveling direction of the beam out of the two points to that at a point of the upstream side of it comes to a desired value.

14. A controller comprising:

an input section for inputting data for the injection energy, storage energy, and accelerating time of a charged particle beam;

an arithmetic section for determining an operating pattern of a component of the accelerator by using the input data; and a control section for outputting a control signal for the component in accordance with the operating pattern.

15. A controller comprising:

an input section for inputting data for the injection energy, storage energy, accelerating time, and storage current of a charged particle beam;

an arithmetic section for determining an operating pattern of a component of the accelerator by using the input data; and a control section for outputting a control signal for the component in accordance with the operating pattern.

16. A controller comprising:

an input section for inputting data for the injection energy, storage energy, accelerating time, extraction energy, and extraction current of a charged particle beam;

an arithmetic section for determining an operating pattern of a component of the accelerator by using the input data; and a control section for outputting a control signal for the component in accordance with the operating pattern.

17. A controller comprising:

an input section for inputting data for the injection energy, storage energy, accelerating time, and storage current of a charged particle beam;

an arithmetic section for determining operating patterns of a first component for bending the beam, a second component for correcting the orbit of the beam, and a third component for accelerating the beam by using the input data; and a control section for outputting control signals for the first, second, and third components in accordance with the operating patterns.

18. A controller comprising:

an input section for inputting data for the injection energy, storage energy, accelerating time, extraction energy, and extraction current of a charged particle beam;

an arithmetic section for obtaining operating patterns of a first component for bending the beam, a second component for correcting the orbit of the beam, a third component for accelerating the beam, and a fourth component for extracting the beam by using the input data; and a control section for outputting control signals for the first, second, third, and fourth components in accordance with the operating patterns.

19. An accelerating system comprising:

an accelerator comprising:

a first component for bending a charged particle beam;

a second component for fine-adjusting the position of the electron beam;

a third component for accelerating the beam;

a fourth component for extracting the beam;

a controller comprising:

a beam current measuring apparatus for measuring the current of a charged particle beam;

a quantity-of-control measuring apparatus for measuring the quantity of control of a component of an accelerator;

a quantity-of-control determining apparatus for determining the quantity of control of the component and outputting a control signal;

a trigger generating apparatus for outputting trigger signals for the outputting of a control signal by the quantity-of-control determining apparatus, measurement of a quantity of control by the quantity-of-control measuring apparatus, measurement of a beam current by the beam current measuring apparatus, and injection, extraction, acceleration, and deceleration of the beam; and a main controller for controlling the outputting of a trigger signal by the trigger generating apparatus and the determination of a quantity of control by the quantity-of-control determining apparatus;

a power supply for supplying power to each of the components in accordance with the control signal outputted from the controller; and a current detector for detecting the current of the beam and transmitting the detection signal to the beam current measuring apparatus of the controller;

a beam transfer system for transferring the beam extracted from the fourth component of the accelerator to an irradiating room; and an irradiating apparatus set in the irradiating room to irradiate an irradiation object with the beam.

20. A controller comprising:

a beam current measuring apparatus for measuring the current of a charged particle beam;

a quantity-of-control measuring apparatus for measuring the quantity of control of a component of an accelerator;

a quantity-of-control determining apparatus for determining the quantity of control of the component and outputting a control signal;

a trigger generating apparatus for outputting trigger signals for the outputting of a control signal by the quantity-of-control determining apparatus, measurement of a quantity of control by the quantity-of-control measuring apparatus, measurement of a beam current by the beam current measuring apparatus, and injection, extraction, acceleration, and deceleration of the beam; and a main controller for controlling the outputting of a trigger signal by the trigger generating apparatus and the determination of a quantity of control by the quantity-of-control determining apparatus.

21. An accelerator comprising:

a first component for bending a charged particle beam;

a second component for fine-adjusting the position of the electron beam;

a third component for accelerating the beam;

a controller for inputting data for the injection energy, storage energy, accelerating time, and storage current of the beam and outputting a control signal for each of the components by using the data; and a power supply unit for supplying power to each of the components in accordance with the control signal outputted from the controller.

22. An accelerator comprising:

an acceleration ring provided with a first component for bending a charged particle beam, a second component for fine-adjusting the position of the electron beam, and a third component for accelerating the beam;

a storage ring provided with the first and second components;

a controller for inputting data for the injection energy, storage energy, accelerating time, and storage current of the beam and outputting a control signal for each of the components by using the data; and a power supply for supplying power to each of the components in accordance with the control signal outputted from the controller.

23. An accelerator comprising:

a first component for bending a charged particle beam;

a second component for fine-adjusting the position of the electron beam;

a third component for accelerating the beam;

a fourth component for extracting the beam;

a controller for inputting data for the injection energy, storage energy, accelerating time, extraction energy, and extraction current of the beam and outputting a control signal for each of the components by using the data; and a power supply for supplying power to each of the components in accordance with the control signal outputted from the controller.

24. An accelerator comprising:

an acceleration ring provided with a first component for bending a charged particle beam, a second component for fine-adjusting the position of the electron beam, a third component for accelerating the beam, and a fourth component for extracting the beam;

a storage ring provided with a fifth component for injecting a beam extracted from the acceleration ring and the first, second, and fourth components;

a controller for inputting data for the injection energy, storage energy, accelerating time, extraction energy, and extraction current of the beam and outputting a control signal for each of the components by using the data; and a power supply for supplying power to each of the components in accordance with the control signal outputted from the controller.

25. An accelerator comprising:

a first component for bending a charged particle beam;

a second component for fine-adjusting the position of the electron beam;

a third component for accelerating the beam;

a controller comprising:

a beam current measuring apparatus for measuring the current of a charged particle beam;

a quantity-of-control measuring apparatus for measuring the quantity of control of a component of an accelerator;

a quantity-of-control determining apparatus for determining the quantity of control of the component and outputting a control signal;

a trigger generating apparatus for outputting trigger signals for the outputting of a control signal by the quantity-of-control determining apparatus, measurement of a quantity of control by the quantity-of-control measuring apparatus, measurement of a beam current by the beam current measuring apparatus, and injection, extraction, acceleration, and deceleration of the beam; and a main controller for controlling the outputting of a trigger signal by the trigger generating apparatus and the determination of a quantity of control by the quantity-of-control determining apparatus;

a power supply unit for supplying power to each of the components in accordance with the control signal outputted from the controller; and a current detector for detecting the current of the beam and transmitting the detection signal to the beam current measuring apparatus of the controller.

26. An accelerator comprising:

a first component for bending a charged particle beam;

a second component for fine-adjusting the position of the electron beam;

a third component for accelerating the beam;

a fourth component for extracting the beam;

a controller comprising:

a beam current measuring apparatus for measuring the current of a charged particle beam;

a quantity-of-control measuring apparatus for measuring the quantity of control of a component of an accelerator;

a quantity-of-control determining apparatus for determining the quantity of control of the component and outputting a control signal;

a trigger generating apparatus for outputting trigger signals for the outputting of a control signal by the quantity-of-control determining apparatus, measurement of a quantity of control by the quantity-of-control measuring apparatus, measurement of a beam current by the beam current measuring apparatus, and injection, extraction, acceleration, and deceleration of the beam; and a main controller for controlling the outputting of a trigger signal by the trigger generating apparatus and the determination of a quantity of control by the quantity-of-control determining apparatus;

a power supply for supplying power to each of the components in accordance with the control signal outputted from the controller; and a current detector for detecting the current of the beam and transmitting the detection signal to the beam current measuring apparatus of the controller.

27. An accelerating system comprising:

an accelerator comprising:

an acceleration ring provided with a first component for bending a charged particle beam, a second component for fine-adjusting the position of the electron beam, a third component for accelerating the beam, and a fourth component for extracting the beam;

a storage ring provided with a fifth component for injecting a beam extracted from the acceleration ring and the first, second, and fourth components;

a controller for inputting data for the injection energy, storage energy, accelerating time, extraction energy, and extraction current of the beam and outputting a control signal for each of the components by using the data; and a power supply for supplying power to each of the components in accordance with the control signal outputted from the controller;

a beam transfer system for transferring the beam extracted from the fourth component of the accelerator to an irradiating room; and an irradiating apparatus set in the irradiating room to irradiate an irradiation object with the beam.

28. An accelerating system comprising:

an accelerator comprising:

an acceleration ring provided with a first component for bending a charged particle beam, a second component for fine-adjusting the position of the electron beam, a third component for accelerating the beam, and a fourth component for extracting the beam;

a storage ring provided with a fifth component for injecting a beam extracted from the acceleration ring and the first, second, and fourth components;

a controller for inputting data for the injection energy, storage energy, accelerating time, extraction energy, and extraction current of the beam and outputting a control signal for each of the components by using the data; and a power supply for supplying power to each of the components in accordance with the control signal outputted from the controller;

a beam transfer system for transferring the beam extracted from the fourth component of the accelerator to a plurality of irradiating rooms;

a distributing apparatus for distributing the beam to the plurality of irradiating rooms; and an irradiating apparatus set in the irradiating room to irradiate an irradiation object with the beam.

29. An accelerating system comprising:

an accelerator comprising:

a first component for bending a charged particle beam;

a second component for fine-adjusting the position of the electron beam;

a third component for accelerating the beam;

a controller comprising:

a beam current measuring apparatus for measuring the current of a charged particle beam;

a quantity-of-control measuring apparatus for measuring the quantity of control of a component of an accelerator;

a quantity-of-control determining apparatus for determining the quantity of control of the component and outputting a control signal;

a trigger generating apparatus for outputting trigger signals for the outputting of a control signal by the quantity-of-control determining apparatus, measurement of a quantity of control by the quantity-of-control measuring apparatus, measurement of a beam current by the beam current measuring apparatus, and injection, extraction, acceleration, and deceleration of the beam; and a main controller for controlling the outputting of a trigger signal by the trigger generating apparatus and the determination of a quantity of control by the quantity-of-control determining apparatus;

a power supply unit for supplying power to each of the components in accordance with the control signal outputted from the controller; and a current detector for detecting the current of the beam and transmitting the detection signal to the beam current measuring apparatus of the controller; and a pattern transferring apparatus for transferring a desired pattern onto a semiconductor substrate by using a radiation beam extracted from the first component of the accelerator.

30. An accelerating system comprising:

an accelerator comprising:

a first component for bending a charged particle beam;

a second component for fine-adjusting the position of the electron beam;

a third component for accelerating the beam;

a controller for inputting data for the injection energy, storage energy, accelerating time, and storage current of the beam and outputting a control signal for each of the components by using the data; and a power supply unit for supplying power to each of the components in accordance with the control signal outputted from the controller; and a pattern transferring apparatus for transferring a desired pattern onto a semiconductor substrate by using a radiation beam extracted from the first component of the accelerator.

31. An accelerating system comprising:

an accelerator comprising:

a first component for bending a charged particle beam;

a second component for fine-adjusting the position of the electron beam;

a third component for accelerating the beam;

a fourth component for extracting the beam;

a controller for inputting data for the injection energy, storage energy, accelerating time, extraction energy, and extraction current of the beam and outputting a control signal for each of the components by using the data; and a power supply for supplying power to each of the components in accordance with the control signal outputted from the controller;

a beam transfer system for transferring the beam extracted from the fourth component of the accelerator to an irradiating room; and an irradiating apparatus set in the irradiating room to irradiate an irradiation object with the beam.

32. An accelerating system comprising:

an accelerator comprising:

a first component for bending a charged particle beam;

a second component for fine-adjusting the position of the electron beam;

a third component for accelerating the beam;

a fourth component for extracting the beam;

a controller for inputting data for the injection energy, storage energy, accelerating time, extraction energy, and extraction current of the beam and outputting a control signal for each of the components by using the data; and a power supply for supplying power to each of the components in accordance with the control signal outputted from the controller;

a beam transfer system for transferring the beam extracted from the fourth component of the accelerator to a plurality of irradiating rooms;

a distributing apparatus for distributing the beam to a plurality of irradiating rooms; and an irradiating apparatus set in the irradiating room to irradiate an irradiation object with the beam.

33. An accelerating system comprising:

an accelerator comprising:

an acceleration ring provided with a first component for bending a charged particle beam, a second component for fine-adjusting the position of the electron beam, and a third component for accelerating the beam;

a storage ring provided with the first and second components;

a controller for inputting data for the injection energy, storage energy, accelerating time, and storage current of the beam and outputting a control signal for each of the components by using the data; and a power supply for supplying power to each of the components in accordance with the control signal outputted from the controller; and a pattern transferring apparatus for transferring a desired pattern onto a semiconductor substrate by using a radiation beam extracted from the first component of the accelerator.

* * * * *